US010961005B1

(12) United States Patent
Epstein

(10) Patent No.: US 10,961,005 B1
(45) Date of Patent: Mar. 30, 2021

(54) SELF-PROPELLED, PACKAGING FILM PERFORATING SYSTEM USED IN HORIZONTAL, FORM, FILL, AND SEAL PACKAGING MACHINES

(71) Applicant: Moshe Epstein, Northbrook, IL (US)

(72) Inventor: Moshe Epstein, Northbrook, IL (US)

( * ) Notice: Subject to any disclaimer, the term of this patent is extended or adjusted under 35 U.S.C. 154(b) by 0 days.

(21) Appl. No.: 16/380,985

(22) Filed: Apr. 10, 2019

(51) Int. Cl.
*B65B 61/02* (2006.01)
*B65B 41/12* (2006.01)
*B65B 9/04* (2006.01)

(52) U.S. Cl.
CPC ..... *B65B 61/02* (2013.01); *B65B 9/04* (2013.01); *B65B 41/12* (2013.01)

(58) Field of Classification Search
CPC .. B65B 9/04; B65B 9/06; B65B 41/12; B65B 61/02

(Continued)

(56) References Cited

U.S. PATENT DOCUMENTS 2,801,439 A * 8/1957 Meares ..... B29C 69/001 366/71
3,152,500 A * 10/1964 Watts ..... B26D 7/18 83/302

(Continued)

*Primary Examiner* — Thanh K Truong
*Assistant Examiner* — David G Shutty
(74) *Attorney, Agent, or Firm* — Steven Ivy P.C.

(57) ABSTRACT

Disclosed is a packaging film perforating system used in commercially available, horizontal, form, fill and seal packaging machines. The packing film perforating system is attached to a packaging machine via a mounting module. The system is designed to create perforation lines in the packaging film, housing pre-packaged product, being moved by a conveying chain between various functional stations located on said packaging machine.

The perforating system is positioned as the last automated station of the packaging machine, and is typically preceded by a plurality of other automated stations designed to fully complete the packaging process. The stations preceding the location of the perforation system may include stations designed to feed both the bottom and the top layers of the packaging film, product fill station, and both the bottom and the top package forming stations.

The packaging film perforating system comprises of four primary modules: 1) perforating module assembly, for perforating the packaging film; 2) mounting module assembly, for mounting the perforating module to the machine and for enabling rotation of said perforating module; 3) packaging machine, having a package perforation station for placing therein the perforating module, held by the mounding module; 4) and a plurality of mounting hardware, used for completion of said assemblies.

The perforating module assembly is sub-divided into two components: 1) shaft; 2) perforating disc sub-assembly. The perforating disc slides onto the shaft, and is releasably locked in place. The shaft may hold one or a multitude of the perforating discs. Spaces between said perforating disc may be adjusted to accommodate various shapes and sizes of the packaged products.

Each perforating disc comprises of a back disc, a front disc, and a plurality of knives. Wherein each of said knives has one blunt edge and one sharp edge. The knives are configured to be equally spaced, with all blunt edges facing in the same direction, and are positioned around the outside perimeter of the two discs. The knives are sandwiched between the two discs, locked in place, made to extend beyond the two discs' outside perimeter.

The perforating module is held by the mounting module, by having both ends of the shaft fitted inside bearings, held by two bearing blocks. Using actuators, the bearing blocks along with attached thereto perforating module, are moved up and down, allowing the perforating discs to engage or to disengage the packaging film, located directly below the (Continued)

mounting module. Once engaged, the conveyed packaging film pushes on the blunt edge of the knives, causing the perforating disc to rotate, without application of any external power. The rotation of the perforating disc generates equally-spaced, elongated cuts in the packaging film, forming perforation lines, outlining the ends of the created packages.

1 Claim, 12 Drawing Sheets

(58) Field of Classification Search
USPC ..... 53/550, 389.3; 83/331
See application file for complete search history.

(56) References Cited

U.S. PATENT DOCUMENTS 4,055,101 A * 10/1977 Collins ..... B26D 7/2614 83/660
4,134,245 A * 1/1979 Stella ..... B29C 65/7451 53/547
4,344,610 A * 8/1982 Jeschke ..... B41F 13/62 270/6
4,712,357 A * 12/1987 Crawford ..... B65B 57/00 53/450
4,722,168 A * 2/1988 Heaney ..... B65B 57/14 53/450
4,999,968 A * 3/1991 Davis ..... B26D 1/626 383/200
5,045,045 A * 9/1991 Davenport ..... B26D 7/2621 493/363
5,201,352 A * 4/1993 Hult ..... B23D 61/065 144/218
5,313,863 A * 5/1994 Aihara ..... B26D 1/245 83/171
5,386,752 A * 2/1995 Siegel ..... B26D 7/14 83/175
5,647,277 A * 7/1997 Devito ..... B26D 7/20 101/226
5,678,390 A * 10/1997 Pruett ..... B29C 65/18 53/450
5,894,709 A * 4/1999 Fosshage ..... B29C 66/8161 53/450
5,966,908 A * 10/1999 Philipp ..... B65B 9/067 53/450
6,119,439 A * 9/2000 Stevie ..... B26D 1/626 53/455
7,343,946 B2 * 3/2008 Stager ..... B27C 1/08 144/176
7,670,275 B2 * 3/2010 Schaack ..... B31F 1/10 493/403
7,708,040 B2 * 5/2010 Stager ..... B27G 13/005 144/176
8,104,617 B2 * 1/2012 Goto ..... B65D 75/5844 206/432
8,220,375 B2 * 7/2012 Boyer, Jr. ..... B26F 1/24 83/660
8,277,368 B2 * 10/2012 Ackermann ..... B65H 45/30 493/454
9,764,939 B2 * 9/2017 Brunnert ..... B68G 15/00
2014/0121085 A1 * 5/2014 Kwarta ..... B26D 9/00 483/10

* cited by examiner

REMOVABLE PERFORATING DISCS ENABLE REDUCTION AND CHANGE OF LOCATIONS OF PERFORATED LINES IN THE PACKAGING FILM

SELF-PROPELLED, PACKAGING FILM PERFORATING SYSTEM USED IN HORIZONTAL, FORM, FILL, AND SEAL PACKAGING MACHINES

FIELD OF THE INVENTION

The present invention relates to the general field of tooling, used in automated, horizontal, packaging machines.

BACKGROUND OF THE INVENTION

The present invention is a direct attempt to improve the design, the functionality, and the cost of manufacturing of an existing, packaging film perforating system, utilized on commercially available, horizontal, form, fill and seal packaging machines.

Unlike the present invention, the existing packaging film perforating systems utilize the electric power to rotate the components made to both engage and to perforate the packaging film. The power used to operate these perforating system is derived from the primary drive of the machine, responsible for moving the packing film between various functional stations of the machine. Which means that the existing film perforators are mechanically lined to the primary drive by using mechanical components, such as pulleys and belts.

In theory, this mechanical connection allows for synchronization of the movement of the packaging film perforator with the movement of the film, but in practice, these components appear to function independently, leading to improper perforations and frequent machine breakdowns.

The new design, presented in this application, does not use any external power to rotate the components responsible for performing the film. The new design utilizes the movement, or the progression of the packaging film to rotate the component designed to perforate the packaging film. This component is a perforation disc. The perforating disc is comprising of a plurality of custom-made knives, sandwiched by two flat discs, made to slidably fit onto a free-rotating shaft.

Unlike the previously designed packaging film perforation components, the knives utilized by the present invention have one blunt edge and one sharp edge, and are configured to extend beyond the two discs' outside perimeter. With all blunt edges facing in the same direction, the knives that penetrate the packaging film, are pushed by the moving packaging film, causing the perforating disc to rotate—creation a self-propelled mechanism. This rotation allows the other knives attached to the discs to perforate the packaging film, not only without the usage of any external power, but also with the speed that is perfectly synchronized with the speed of the progressing packaging film.

SUMMARY OF THE INVENTION

The following information is intended to be a brief summary of the invention, and as such, said information shall not be used as the means of limiting the scope of the invention:

Disclosed is a packaging film perforating system, utilized in conjunction with a commercially available, horizontal, form, fill and seal packaging machine. The system is designed to create perforation lines in the packaging film, holding pre-packaged product, being moved by a conveying chain between various functional stations located on said packaging machine.

The packaging film perforating system comprises of four primary modules: 1) perforating module assembly, for perforating the packaging film; 2) mounting module assembly, for mounting the perforating disc to the machine and for enabling rotation of said perforating module; 3) packaging machine, having a package perforation station for placing therein the perforating module, held by the mounting module; 4) and a plurality of mounting hardware, used for completion said assemblies.

Wherein said perforating module assembly is sub-divided into two components: 1) shaft; 2) perforating disc sub-assembly. The perforating disc slide onto the shaft, and is releasably locked in place. The shaft may hold one or a multitude of the perforating discs. Spaces between said perforating disc may be adjusted to accommodate various shapes and sizes of the packaged products.

Each perforating disc sub-assembly comprises of a back disc, a front disc, and a plurality of knives. Wherein each of said knives has one blunt edge and one sharp edge. The knives are configured to be equally spaced, with all blunt edges facing in the same direction, and are positioned around the outside perimeter of the two discs. The knives are sandwiched between the two discs, locked in place, configured to extend beyond the two discs' outside perimeter.

The perforating module is held by the mounting module, by having both ends of the shaft fitted inside the bearings, held inside the two bearing blocks. Using actuators, the bearing blocks along with attached thereto perforating module, are moved up and down, allowing the perforating discs to engage or to disengage the packaging film, located directly below the mounting module. Once engaged, the conveyed packaging film pushes on the blunt edge of the knives, causing the perforating disc to rotate, without application of any external power. The rotation of the perforating disc generates equally-spaced, elongated cuts in the packaging film, forming perforation lines, outlining the ends of the created packages.

BRIEF DESCRIPTION OF THE DRAWINGS

The components shown in the drawings are not to scale. In the interest of clarity, some of the components might be shown in a generalized form and could be identified utilizing commercial designations. All components, including its essential features, have been assigned reference numbers that are utilized consistently throughout the descriptive process outlined herein.

DESCRIPTIVE KEY:

| | |
|---|---|
| 100-405 | PERFORATING SYSTEM |
| 100-119 | PERFORATING MODULE Assembly |
| 100 - | Shaft |
| 101-119 | Perforating Disc Sub-Assembly |
| 101 - | back disc |
| 102 - | bore, back disc |
| 103 - | pin holes, back disc |
| 104 - | clearance holes, back disc |
| 105 - | threaded holes, back disc |
| 106 - | hub |
| 107- | bore, hub |
| 108 - | outside diameter, hub |
| 109 - | threaded mounting holes, hub |
| 110 - | threaded set screw hole, hub |
| 111 - | front disc |
| 112 - | bore, front disc |
| 113 - | pin holes, front disc |
| 114 - | clearance holes, front disc |
| 115 - | knife |
| 116 - | clearance holes, knife |
| 117 - | blunt edge, knife |
| 118 - | sharp edge, knife |
| 200-210 | MOUNTING MODULE Assembly |
| 200 - | base plate |
| 201 - | knife channels, base plate |
| 202 - | mounting clearance holes, base plate |
| 203 - | bracket clearance holes, base plate |
| 204 - | actuator mounting brackets |
| 205 - | threaded holes, mounting bracket |
| 206 - | top surface |
| 207 - | actuators (air cylinders) |
| 208 - | bearing blocks |
| 209 - | guide rods |
| 210 - | bearings |
| 300-314 | HORIZONTAL FORM, FILL AND SEAL Packaging Machine |
| 300 - | power and control station |
| 301 - | computer and operating software |
| 302 - | air compressor |
| 303 - | pneumatic cylinders |
| 304 - | electric motors |
| 305 - | vacuum pump |
| 306 - | packaging film |
| 307 - | bottom packaging film feeding roll |
| 308 - | conveying chain |
| 309 - | bottom package forming station |
| 310 - | product fill station |
| 311 - | packaged product |
| 312 - | top packaging film feeding roll |
| 313 - | top package sealing station |
| 314 - | package perforation station |
| 400-405 | MOUTING HARDWARE Fasteners and Adhesives |
| 400 - | machine screws |
| 401 - | bolts |
| 402 - | washers |

-continued

| DESCRIPTIVE KEY: | |
|---|---|
| 403 - | nuts |
| 404 - | set screws |
| 405 - | adhesive |
| 406 - | roll pins |

DETAILED DESCRIPTION OF THE PREFERRED EMBODIMENT

Figure 1:
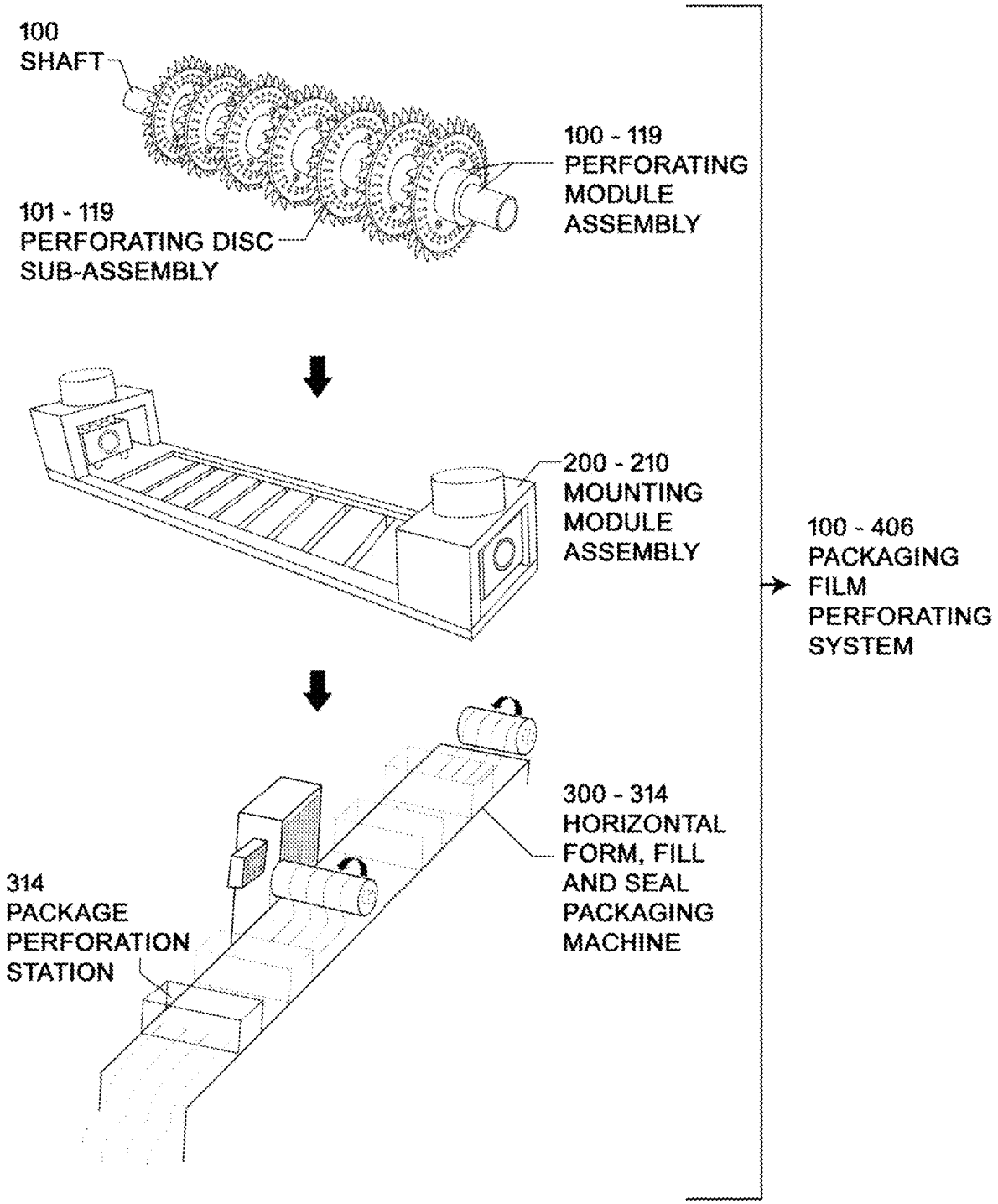
FIG. 1 shows the packaging film perforation system sub-divided into four primary components (modules); said components include the perforation module assembly (comprising of a shaft and a perforation disc sub-assembly), the horizontal form, fill, seal packaging machine (containing the package perforation station for mounting the perforating module held by the mounting module), and the mounting hardware (comprising of screws, washers, nuts, adhesive), in accordance with an exemplary embodiment of the present invention.
Figure 2:
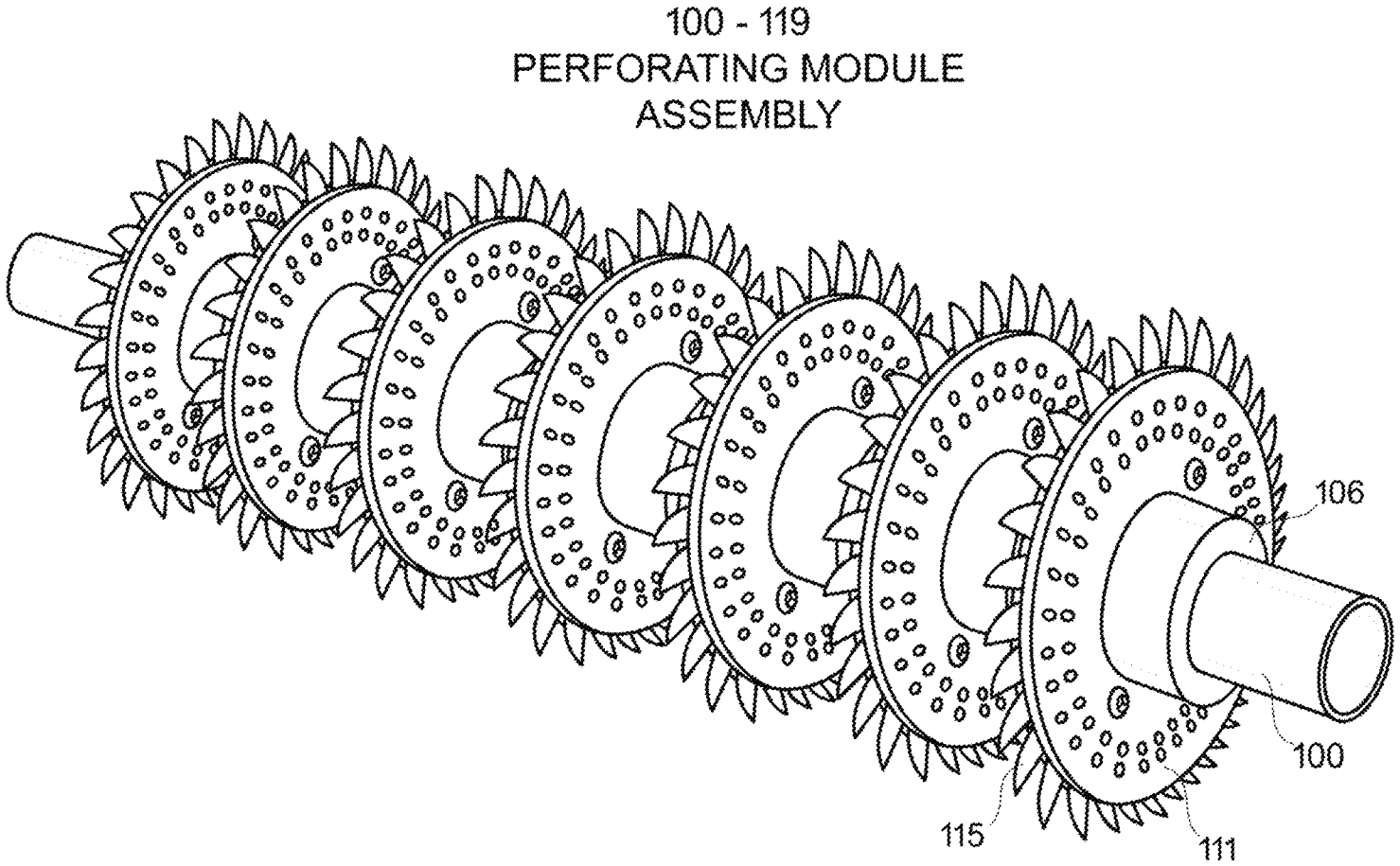
FIG. 2 is a perspective view of the perforating module assembly, comprising of a shaft holding seven perforating disc sub-assemblies, in accordance with an exemplary embodiment of the present invention.
Figure 6:
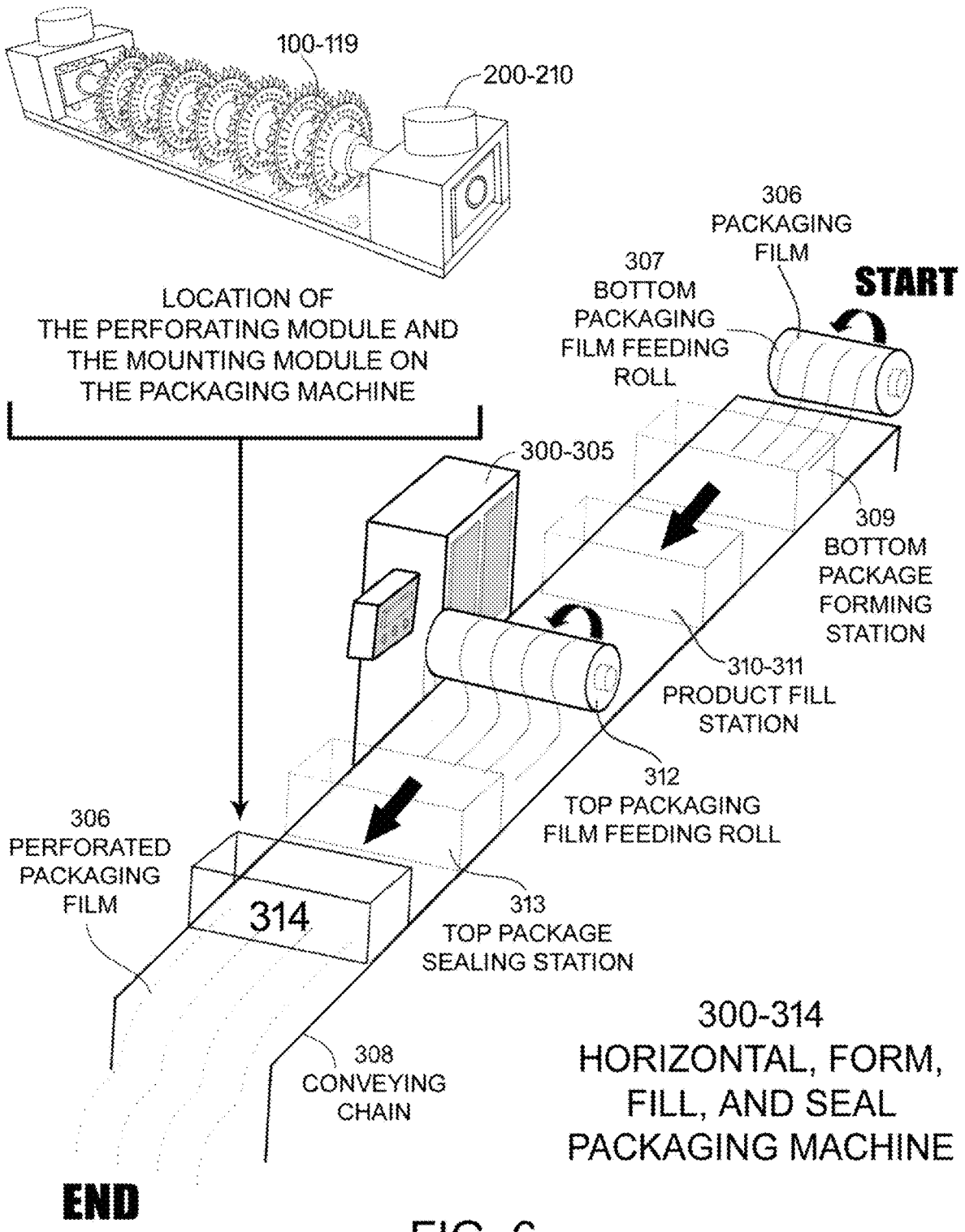
FIG. 6 is a simplified, perspective view of a horizontal, form, fill, and seal packaging machine, designed to show the location of the perforating module (held by the mounting module) on the packaging machine, and the locations of other related stations/components, including the location of the machine's power/control station, packaging film, bottom packaging film feeding roll, conveying chain, bottom package forming station, product fill station, top packaging film feeding roll, top package sealing station, in accordance with an exemplary embodiment of the present invention.

The following description references to the above-defined drawings and represents only an exemplary embodiment of the invention. It is foreseeable, and recognizable by those skilled in the art, that various modifications and/or substitutions to the invention could be implemented without departing from the scope and the character of the invention:

Disclosed is a packaging film perforating system 100-406 (shown in FIGS. 1, 4 and 6), used in conjunction with the commercially available, horizontal, form, fill, and seal packaging machine 300-314 (shown in FIGS. 1 and 6). The perforation system 100-406 is designed to create perforation lines in the packaging film 306, housing pre-packaged product 311, being moved off the machine by a conveying chain 308.

As shown in FIG. 1, the packaging film perforating system 100-406 comprises of four primary modules: 1) perforating module assembly 100-119, which further comprises of a shaft 100 and at least one perforation disc 101-119 sub-assembly, utilized for perforating the packaging film 306; 2) mounting module assembly 200-210, for mounting the perforating module 100-119 to the packaging machine 300-314, and for enabling rotation of said perforating module; 3) packaging machine 300-314, having a package perforation station 314, for placing therein the perforating module 1100-119, held by the mounting module 200-210; 4) and a plurality of mounting hardware, 400-406, used for completion of said assemblies.

Figure 8:
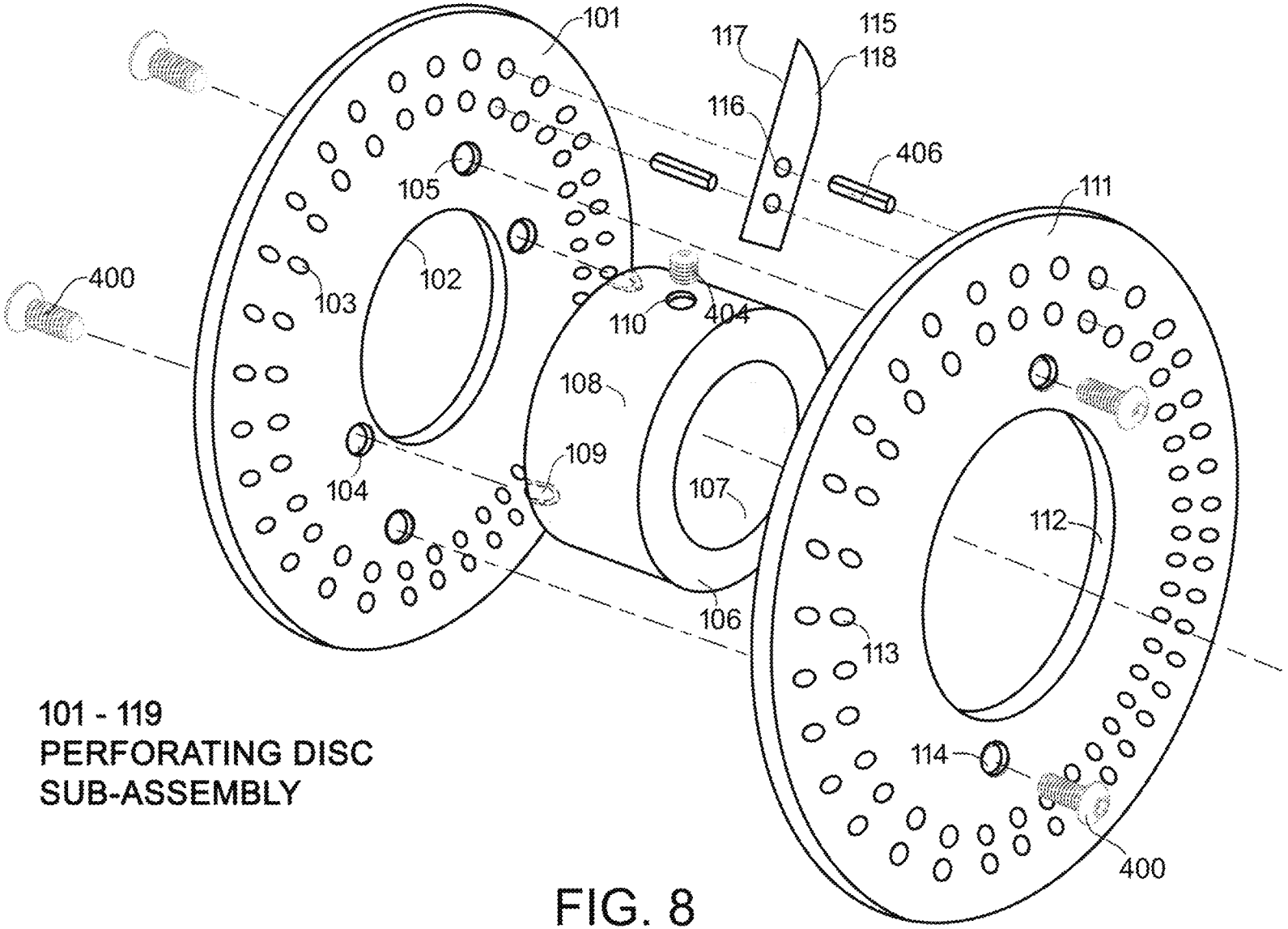
FIG. 8 is an exploded view of the perforating disc sub-assembly, providing a perspective view of each individual component, including the back disc, hub, front disc, knife, machine screws, and roll pins, in accordance with an exemplary embodiment of the present invention.
Figure 9:
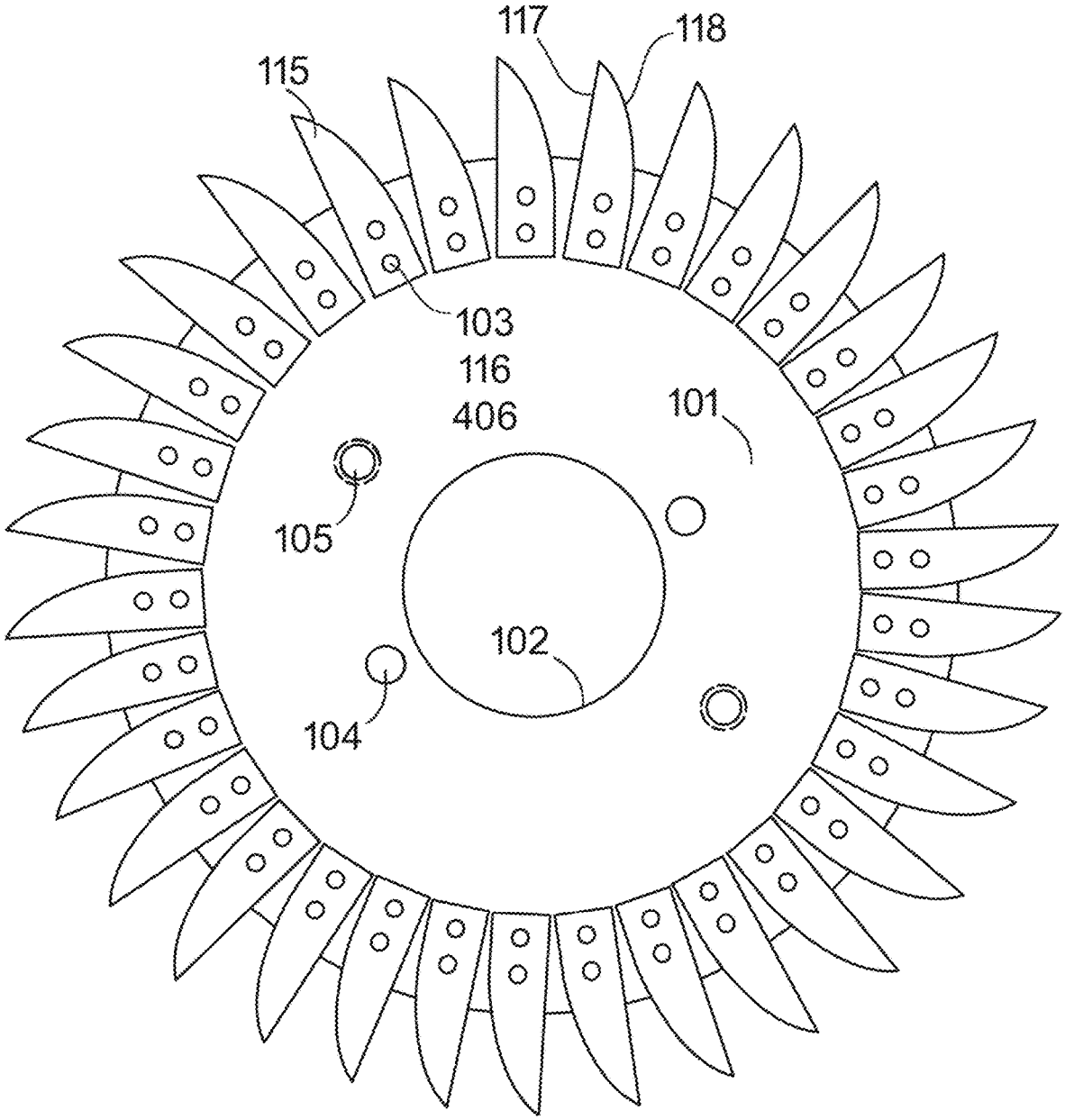
FIG. 9 is a top view of the back disc, and attached thereto a plurality of knives, made to show not only the positioning of the knives on said back disc, but also to show the location, inside the fully assembled perforation disc, of the knives when said knives are sandwiched between the back disc and the front disc (the front disc in not shown in this figure), in accordance with an exemplary embodiment of the present invention.
Figure 10:
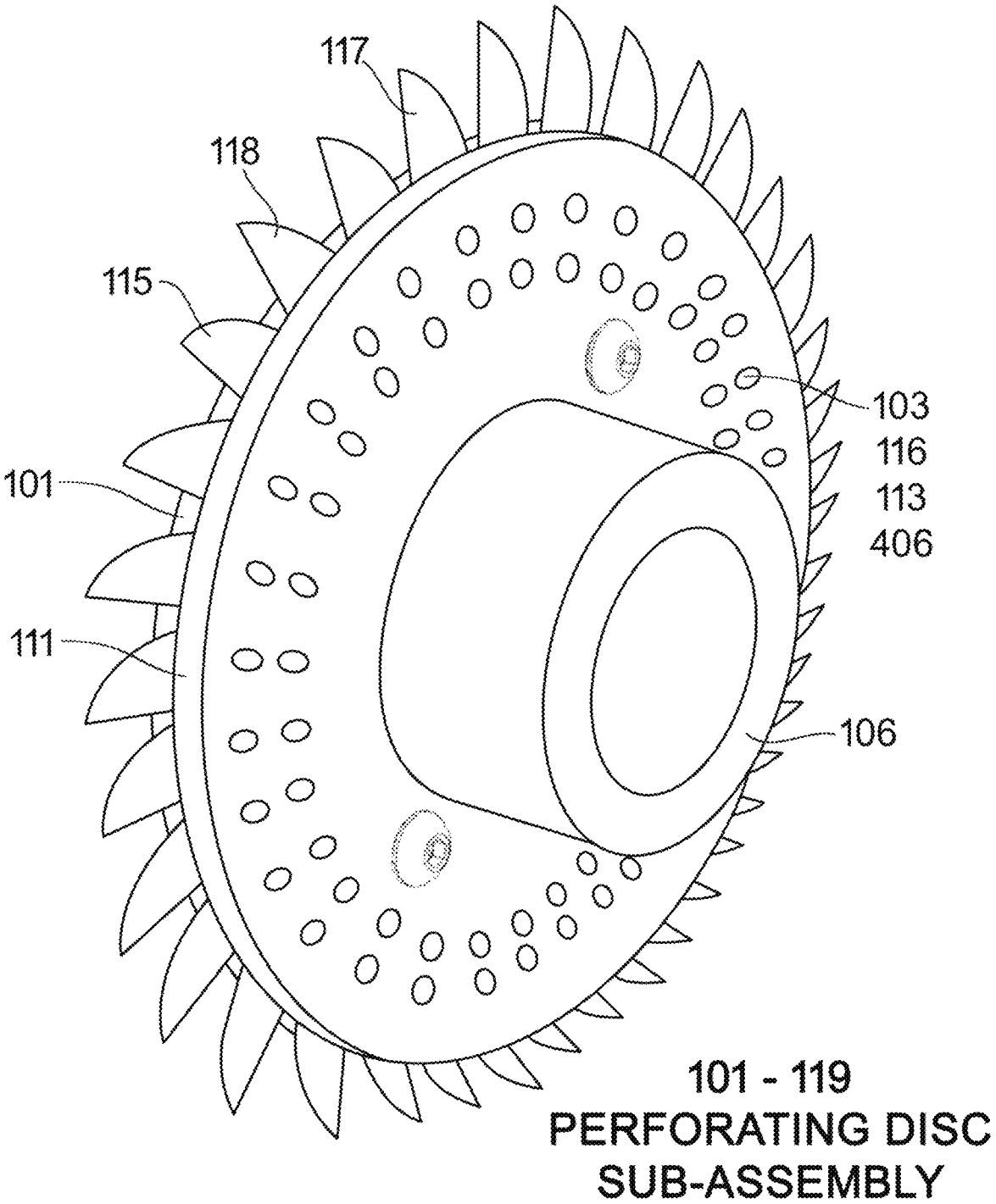
FIG. 10 is a perspective view of the perforating disc sub-assembly, comprising of the following components: back disc 110, hub 120, front disc 130, knives 140; assembled utilizing a plurality of roll pins and machine screws 310; in accordance with an exemplary embodiment of the present invention.

The first step in utilizing the packing film perforation system 100-406, requires completion of the perforation disc sub-assembly 101-119 (shown in FIGS. 8, 9 and 10). The perforating disc sub-assembly comprises of a back disc 101, a hub 106, a front disc 111, and a plurality of knives 115, which are sandwiched between the back and the front discs. The front disc 111 is fixedly-attached to the back disc 101 using a plurality of mounting hardware. The knives 115 are fixedly-attached to the front disc 111 and the back disc 101 using a plurality of mounting hardware. The mounting hardware utilized in this example is selected from a group consisting of machine screws, bolts, washers, nuts, set screws, adhesives, and roll pins.

The back disc 101 comprises of a centrally-located bore 102, for inserting the back disc 101 onto the perforating module's shaft 100; a plurality of clearance holes 104, made for inserting the machine screws 400, for attaching the back disc 101 to the hub 106; a plurality of pin holes 103 for inserting the roll pins 406 for attaching the knives 115 to the back disc 101; a plurality of threaded holes 105 for inserting the machine screws for attaching the back disc 101 to the front disc 111.

The back disc 101 incorporates a means for locking said perforating disc 101-119 in place on said shaft 100, so that a rotation of said shaft 100 will cause a corresponding rotation of said perforating disc 101-119. Here, said means for locking the perforating disc onto the shaft are provided by usage of the hub 106 and a set screw 404; but other methods of accomplishing the same mechanical function may be used (e.g. by applying threaded collars, welding methods, snap pins, clamps and/or clips).

As shown in FIG. 8, the hub 106 (having a bore 107, an outside diameter 108, threaded mounting holes 109, and threaded set screw hole 110) is attached to the back disc 101 by inserting machine screws 400 through the clearance holes 104 into the hub's threaded mounting holes 109. The hub 106 has a threaded set screw hole 110 protruding through the outside diameter 108 into the bore 107. This threaded hole 110 is used for inserting therein the set screw 404, that upon making contact with the shaft 100, will releasably lock the back disc 101 to said shaft 100.

The next step focuses on attachment of the front disc 111 to the back disc 101. The front disc 111, has a bore 112 for inserting said front disc onto the outside diameter of the hub 108; a plurality of pin holes 113 for inserting the roll pins 406 for attaching the knives 115 to the back disc; a plurality of clearance holes 114 for inserting the machine screws 400, for attaching the front disc 111 to the back disc 101. However, before the back 101 and the front discs 111 are firmly locked together, the end-user must attach the knives 115, used for perforating the packing film 306.

As shown in FIGS. 8, 9 and 10, the knives 115 have a sharp edge 118 and a blunt edge 117. The knives 115 are disposed at equivalent intervals around an outside perimeter of the back disc 101 and the front disc 111, the blunt edges 117 of the knives must face in the same direction. The knives 115 have a plurality of clearance holes 116 for inserting therein the roll pins 406, made to fixedly-attach the knives 115 to both discs.

To attach the knives 115, the end-user must place the knives 115 between the back disc 101 and the front disc 111, align the knives' clearance holes 116 with the pins holes of the back 103 and the front disc 113, and insert the roll pins 406, thereby locking the knives 115 in place. The knives 115 are configured to protrude outward beyond the outside perimeter of the back disc 101 and the front disc 111, as shown in FIGS. 9 and 10.

Figure 3:
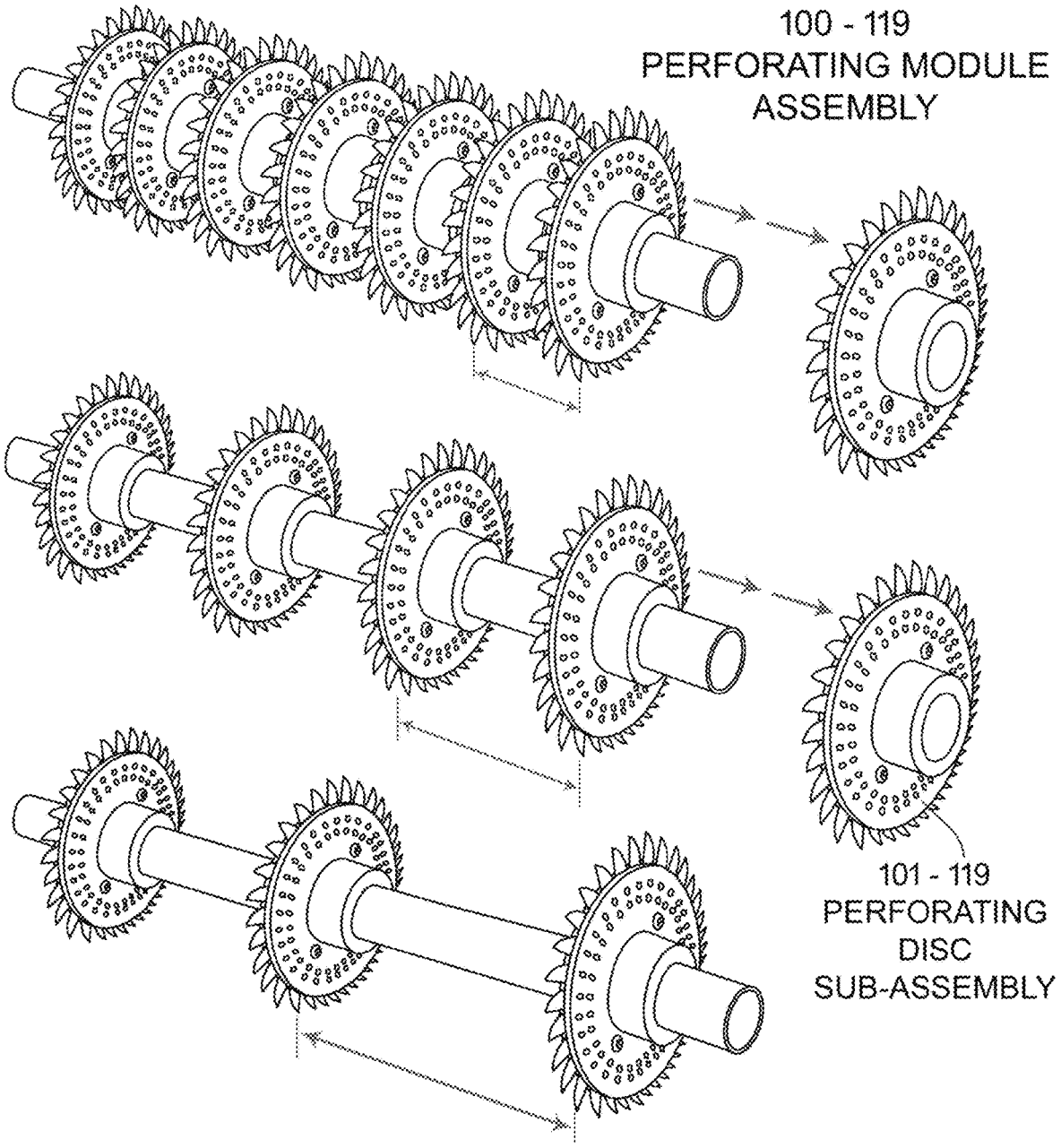
FIG. 3 shows three perspective views of the perforating module assembly (each comprising of the shaft and a plurality of perforating disc sub-assemblies); wherein the disclosed first perforating assembly comprises of seven perforating discs, the second perforating assembly comprises of four perforating discs, and the third perforating assembly comprises of only three perforating discs; the three perspective views of the perforating module are made to illustrate that the removable perforating disc sub-assemblies provide the end-user the ability to reduce or to add lines of perforation in the packaging film, as well as the flexibility to changes in the distances between said perforating lines, to accommodate the varying sizes of the products packaged by the horizontal form, fill, and seal packaging machine.

Once the perforating disc sub-assembly 101-119 has been completed, the perforating disc 101-119 may be placed onto the shaft 100. As shown in FIG. 3, the end-user may choose to utilize any number of perforation discs 101-119, and by using the releasable means of locking the perforating disc 101-119 to the shaft 100, change the distance between said discs, to accommodate varying shapes and sizes of the packaged products 311.

Figure 4:
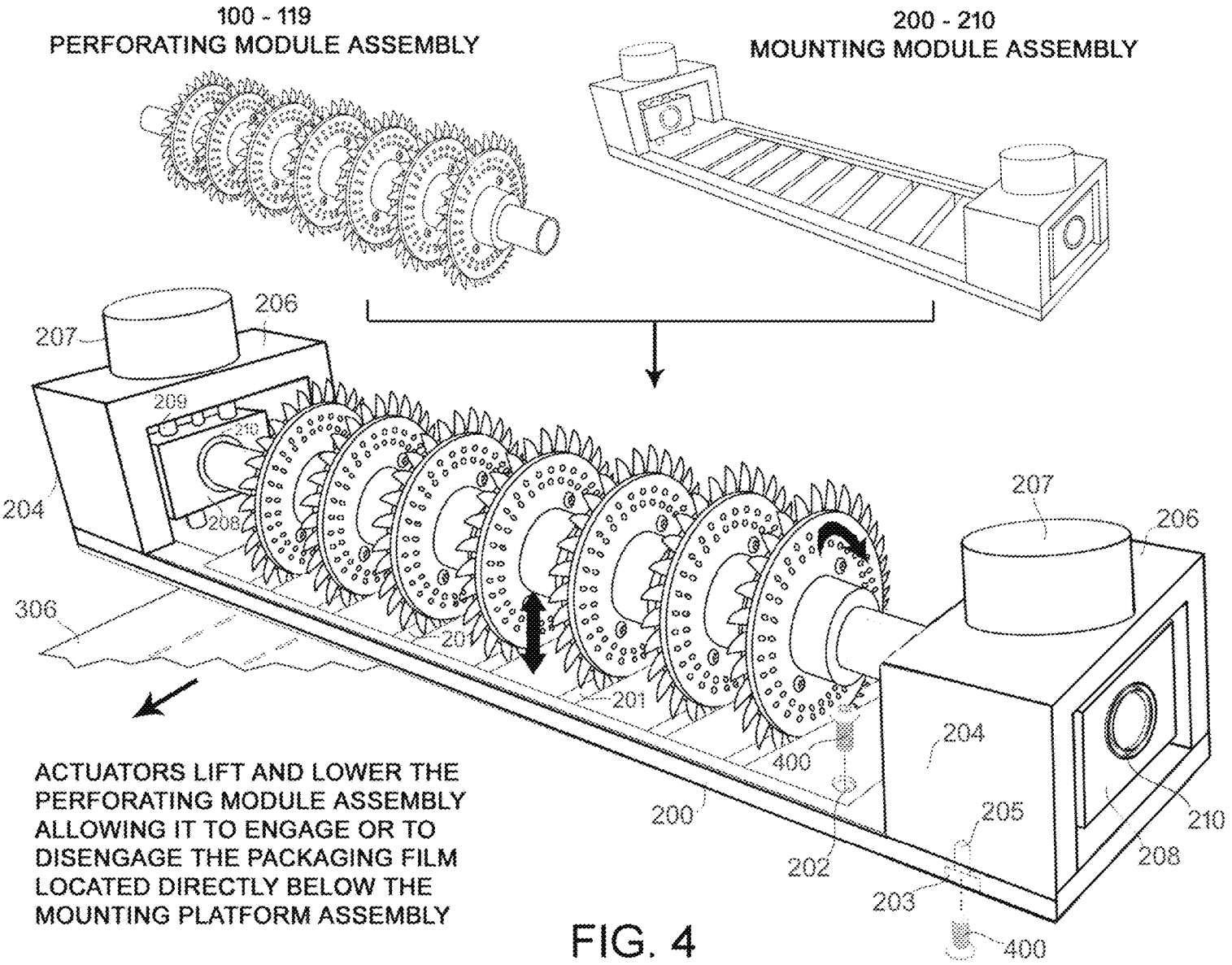
FIG. 4 shows three perspective views, including the views of the perforating module assembly, the mounting module assembly, and an annotated view of the perforating module held by the mounting module; wherein said annotation addresses the usage of the actuators (e.g. air cylinders) by the mounting module assembly, enabling said actuators to lift or to lower the perforating module, allowing it to engage or to disengage the packaging film located directly below the mounting module, in accordance with an exemplary embodiment of the present invention.
Figure 5:
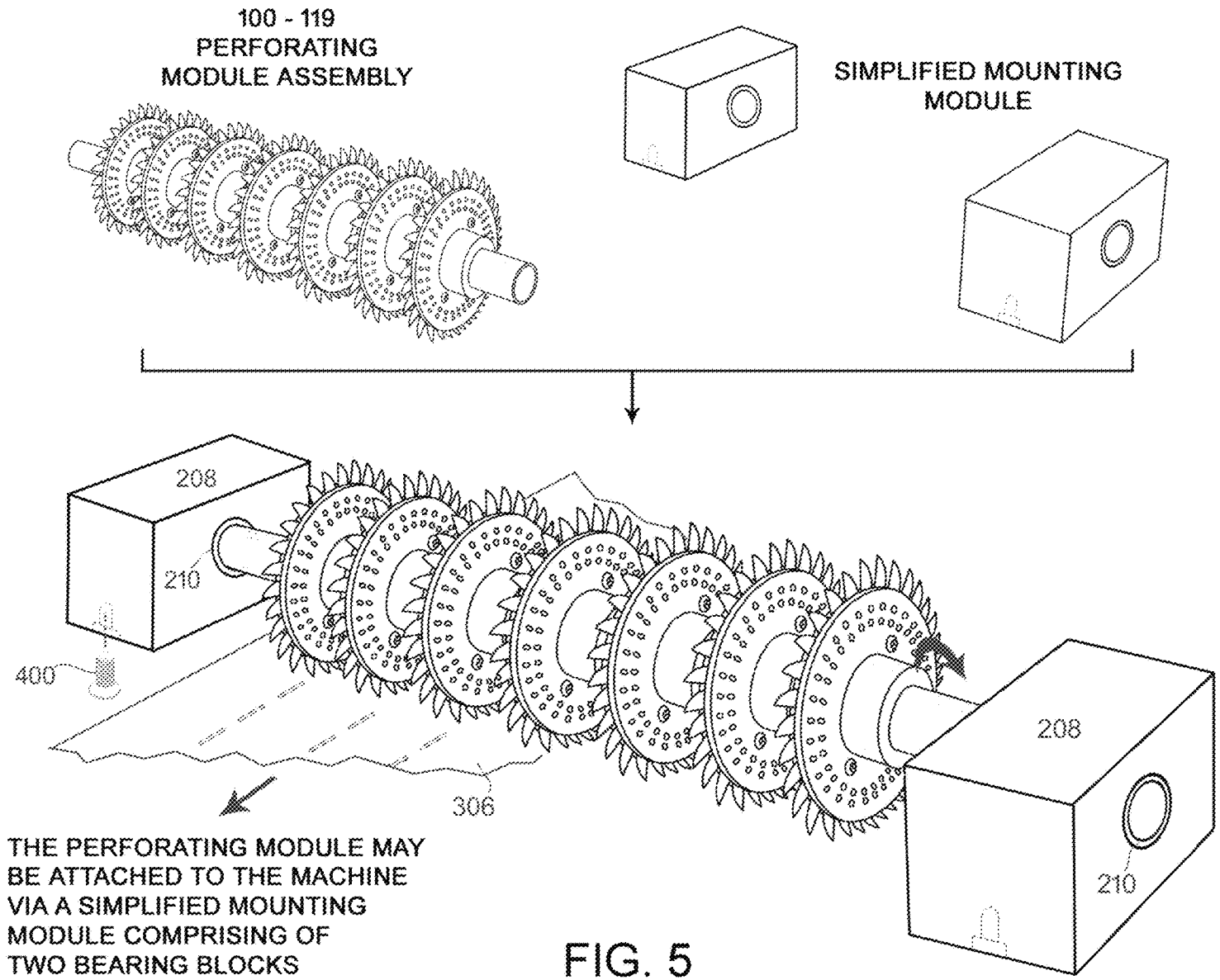
FIG. 5 shows three perspective views, including the views of the perforating module assembly, the simplified mounting module assembly, and an annotated view of the perforating module held by the simplified mounting module comprising of two bearing blocks; wherein said annotation explains that a simplified mounting module may be utilized as a substitute for the mounting module shown in FIG. 4, thus eliminating the need for the actuators and other related components, in accordance with an exemplary embodiment of the present invention.

As shown in FIGS. 4 and 5, the fully assembled perforating module 100-119 is attached to the mounting module 200-210, wherein said mounting module is used for mounting the perforating module 100-119 to the packaging machine 300-314. The mounting module may have different configurations. Said configurations may vary from a very simplistic, shown in FIG. 5, to more complex configuration shown in FIG. 4.

The simplified mounting module of FIG. 5 comprise of two bearing blocks, with each of said block housing one bearing. This module is configured to hold the shaft 100 of the perforating module 100-119, and to enable the perforating module's free rotational motion. However, tests of the simplified mounting module, determined that this design causes some difficulty in initiating the process of perforating the delicate packaging film, and creates other set up related issues. It was further determined that incorporation of other components, including a base plate 200 and two actuators 207 (air cylinders designed to lift and to lower the perforation assembly 100-119 into the packing film), resolve the aforementioned issues. As a result, a new configuration of the mounting module has been created, and is claimed in this application as the mounting module assembly 200-210. The two bearing blocks 208 of the simplified mounting module, have identical configuration as the two bearing blocks used in the new configuration of the mounting module. These bearing blocks are fixedly-attached to the machine (when using the simplified mounting module) or to the base plate (when using the new configuration of the mounting module), using a plurality of mounting hardware. The mounting hardware utilized in this example is selected from a group consisting of machine screws, bolts, washers, nuts, set screws, adhesives, and roll pins.

Figure 7:
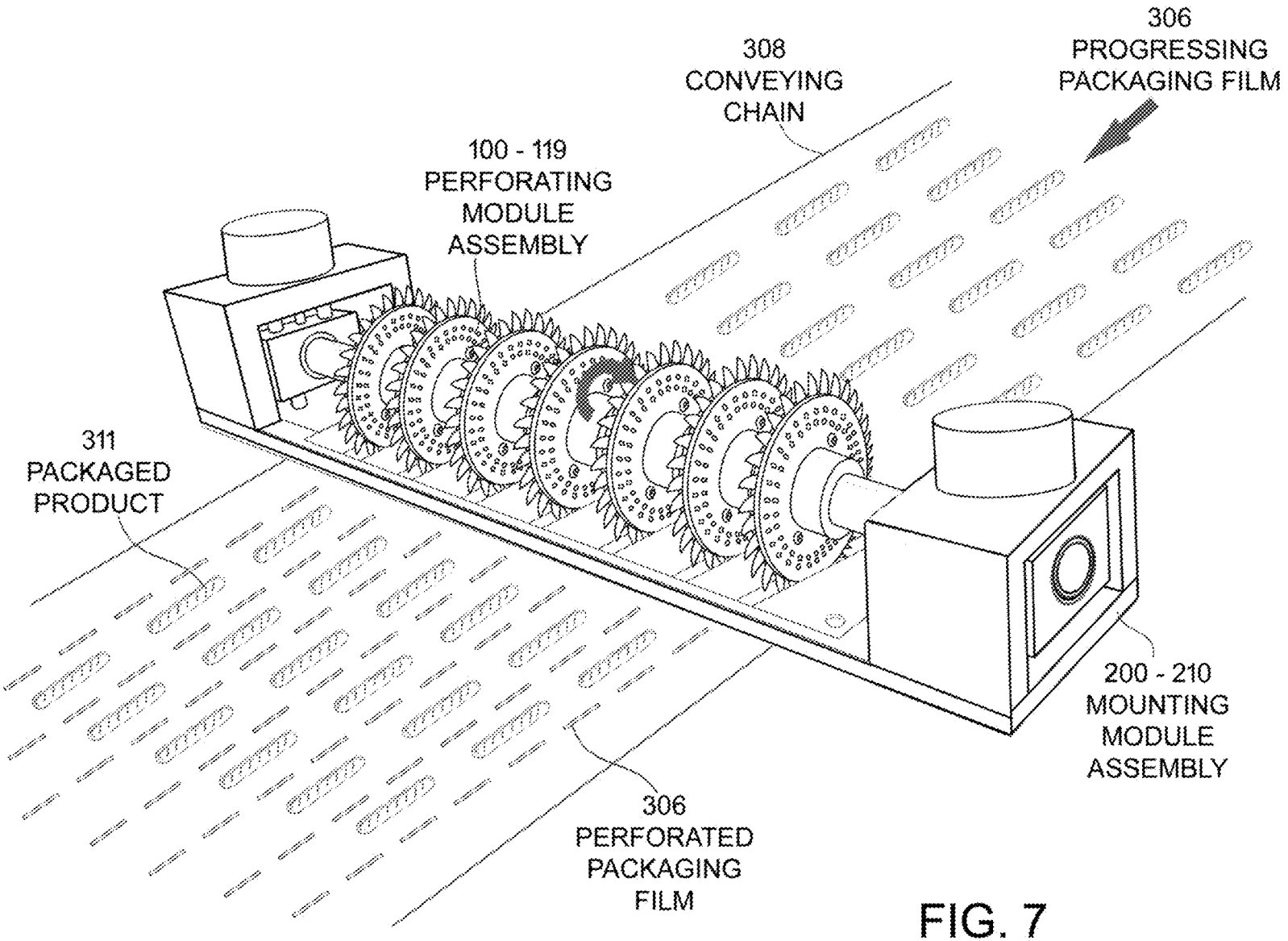
FIG. 7 is a perspective view of the perforation module, attached to the mounting module, shown in relation to the conveying chain, and the positioning of the packaging film, carrying the packed product; this figure also shows the direction of the progressing packaging film, and the direction of the rotation of the perforating module, caused by the packaging film pushing on the knives attached to the perforating discs, in accordance with an exemplary embodiment of the present invention.

As shown in FIGS. 4 and 7, the mounting module 200-210 comprises of two bearings 210, each held by a separate bearing block 208; two actuators 207, for creating a vertical movement of said bearing blocks 208; two actuator mounting brackets 204, U-shaped, having a top surface 206 for mounting the actuator 207, and a plurality of threaded holes 205 for inserting the machines screws 400 for attaching (in an upside-down position) the actuator mounting brackets 204 to a base plate 200; a plurality of guide rods 209, disposed vertically inside the actuator mounting brackets 204, protruding though the bearing blocks 208 for guiding said blocks' vertical movement; a base plate 200, having a plurality of bracket clearance holes 203 for attaching thereto the mounting brackets 204, a plurality of knife channels 201 configured to provide the knives 115 of the perforating disc 101-119 access to the packaging film 306, and a plurality of mounting clearance holes 202 for attaching the base plate 200, and thus the mounting module 200-210 along with the perforating module 100-119, to the packaging machine 300-314.

Once the mounting module 200-210 is firmly attached to the packaging machine 300-314, the perforating module 100-119 may be manipulated with the help of the computer operating software 301, linked to the power and control station 300. Using the actuators 207, the bearing blocks 208 along with attached thereto perforating module 100-119, are moved up and down, allowing the knives 115 of the perforating discs 100-119 to engage, or to disengage, the packaging film 306, located directly below the mounting module 200-210, as shown in FIGS. 4 and 7.

Figure 11:
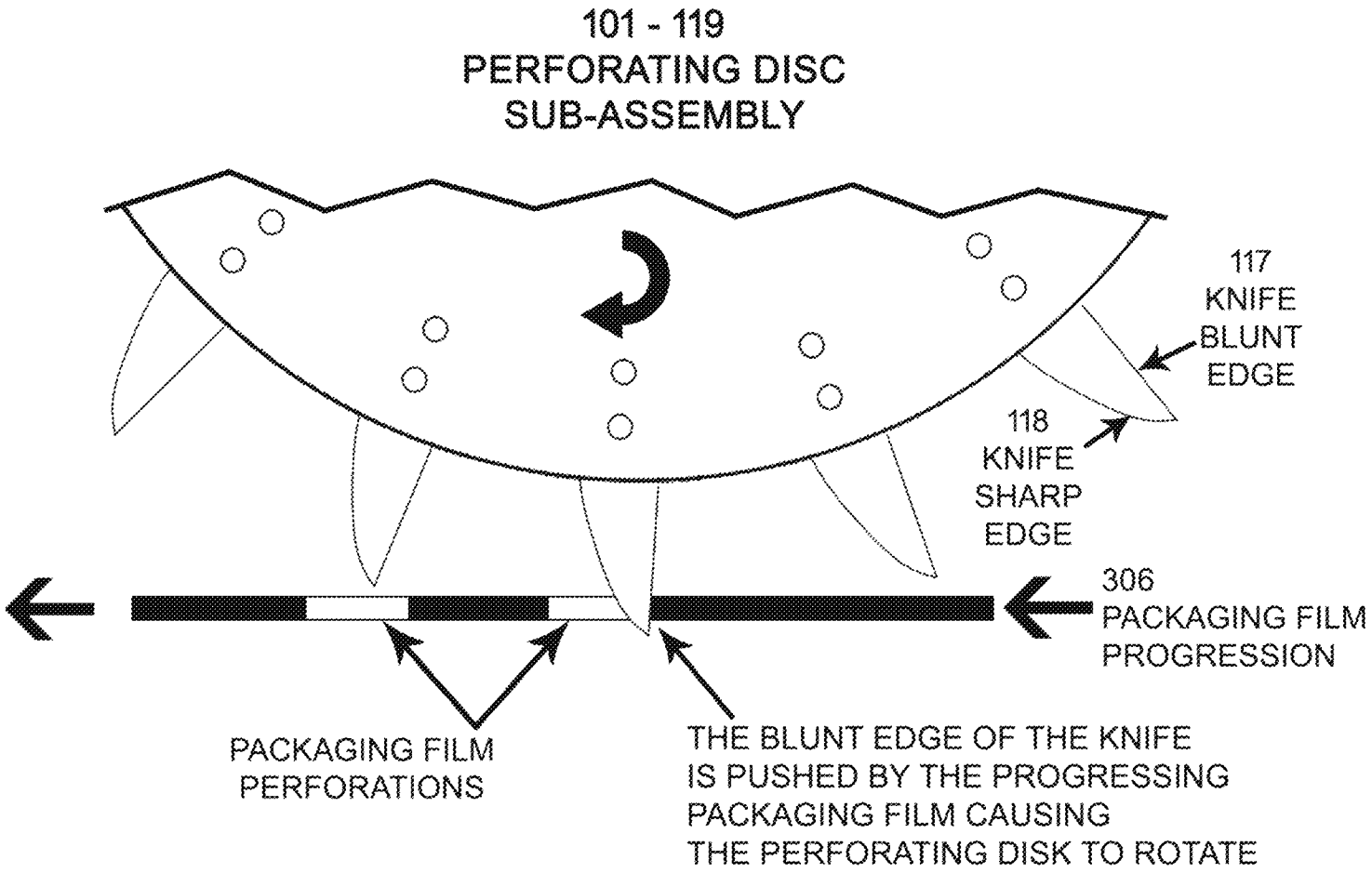
FIG. 11 is a front view of the perforating disc sub-assembly showing a plurality knives protruding therefrom into the packaging firm, positioned directly below the perforating disc; wherein the knives' sharp edges are positioned in the direction of the movement/progression of the packaging film, thereby allowing the blunt edges of said knives to be pushed by the moving film, causing the perforating disc to rotate, enabling the sharp edges to cut elongated, equally-spaced, perforations in the packaging film, in accordance with an exemplary embodiment of the present invention.
Figure 12:
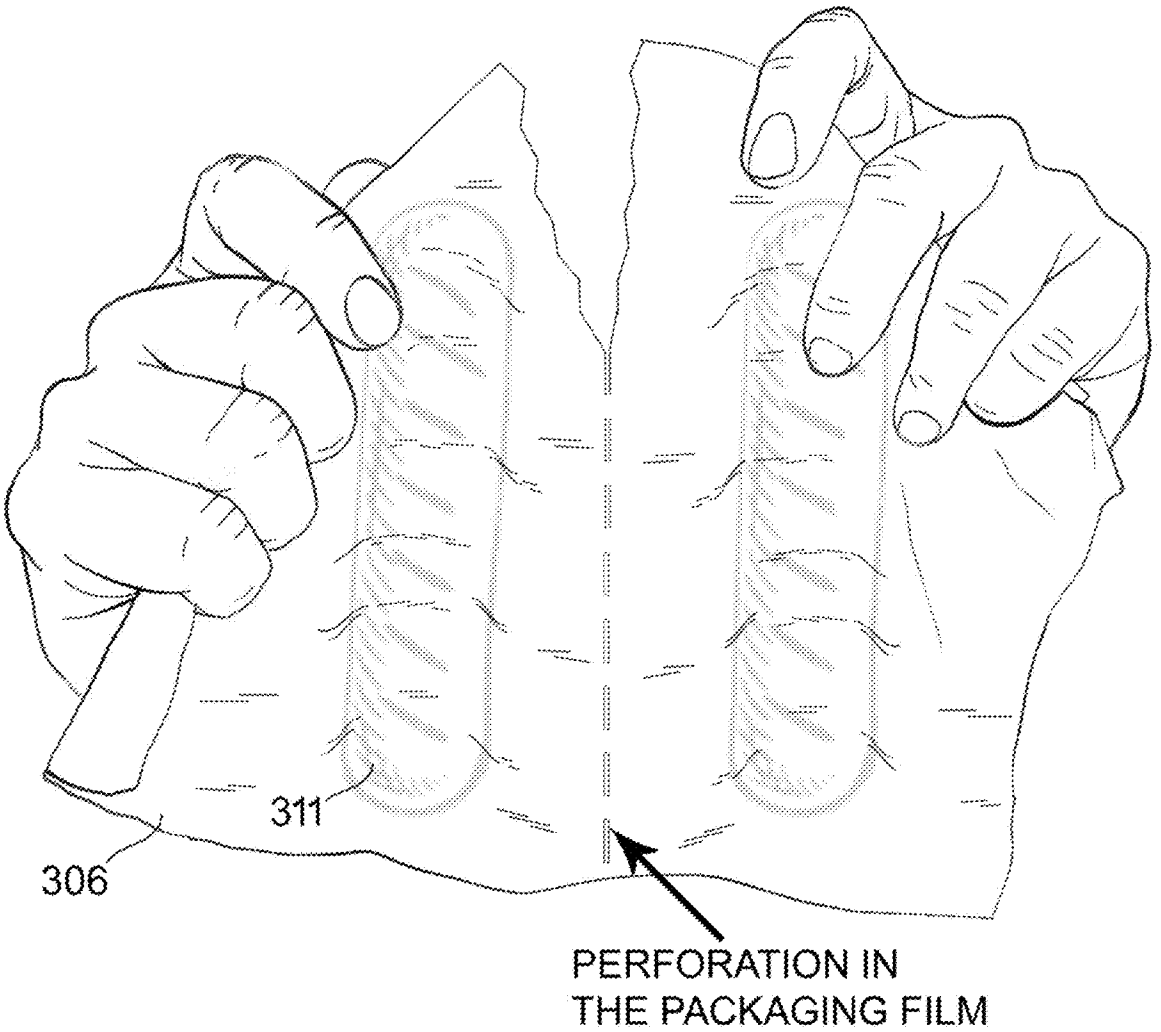
FIG. 12 shows a person holding two pre-packaged product (sausages), joined together, formed from the same sheet of the packaging film; wherein said two packages are separated by a perforation line, made by a single perforating disc, allowing an individual to easily pull apart the two packages, along the perforated line, thereby separating the joined packages into two individual packages, in accordance with an exemplary embodiment of the present invention.

Once engaged, the packaging film 306, moved by the conveying chain 308, pushes on the blunt edge 117 of the knives 115, causing the perforating disc 101-119 to rotate without application of any external power, as shown in FIG. 11. The rotation of the perforating disc 101-119 generates equally-spaced, elongated cuts in the packaging film 306, forming straight perforation lines, outlining the ends of the created packages, referenced in FIG. 12.

The perforating module 100-119 is attached to the machine's package perforation station 314, shown in FIG. 6. The perforation station 314 typically takes the position of the last automated station on the packaging machine 300-314, and is usually preceded by a plurality of other automated stations providing a means for enabling a linear and a rotational motion of components; a means for supplying a packaging film; a means for progressing said packaging film in a horizontal plane; and a means for forming packages from said packaging film.

The means for enabling both the linear and the rotational motions of components is done via the power and control station 300, a plurality of pneumatic cylinders 303, and/or a plurality of electric motors 304. Wherein said power/control station will enable delivery of electricity designed to operate electric motors, compressors, vacuums pumps, and heaters, used for forming packages. The electric motors drive the conveying chain; the air compressors generate the pneumatic power used for air cylinders (actuators); and the vacuum system along with the mechanical tooling, form and seal the package around the product undergoing the packaging process.

The means for supplying a packaging film 306 to the packaging machine 300-314 is a bottom packaging film feeding roll 307, and a top packaging film feeding roll 312. Wherein said feeding rolls incorporate a switch connected to a mechanical trigger. The trigger is designed to set off the switch when the slack in the film is minimized sufficiently to make contact with the mechanical trigger. This contact ultimately lifts the trigger, thereby activating the switch, causing the feeding roll to unwind another, predetermined strip of the packaging film 306. This mechanism is configured to unwind on demand and thereby continually supply a single layer of the packaging film 306 to the convening chain 308 of the packaging machine.

The bottom packaging film feeding roll 307 supplies the packaging film used for forming the bottom portion of the packages; whereas the top packaging film feeding roll 312 supplies the film used for forming the top portion of the packages. The top layer of the packaging film covers the product placed inside the pre-formed bottom portion of the packages, and is used to provide a cover that is sealed onto said pre-formed bottom portion of the packages.

The means for progressing said packaging film 306 in a horizontal plane, between different functional stations of the machine, is a conveying chain 308. Said chain is driven by an electric motor. The chain utilizes a plurality of retractable pins (typically spring-loaded), capable of pinching the outside edges of the conveyed film, providing a reliable grip of the film and enabling the chain to pull the film in a horizontal plane between different functional stations of the machine. Also, by continuously gripping the film, the conveying chain ensures that the form of the film remains flat and unwrinkled, throughout the packaging process.

The means for forming packages from said packaging film is a bottom package forming station 309, a product fill station 310, and a top package sealing station 313 (referenced in FIG. 6).

Wherein said bottom package forming station 309 utilizes a customized tooling, supplied with a vacuum system, configured to draw the film, supplied by the bottom packaging film feeding roll, inside said tooling, and by using a heating element, force the packaging film to retain the tooling's shape, thereby permanently forming the bottom portion of the package.

Wherein said product fill station 310 may utilize a third-party, separately designed custom loading mechanisms, configured to accommodate the specific shape and sizes of the product being packaged. In many packaging machines this station simply identifies a predefined space on the machine. This space may be occupied by one or several individuals, responsible for manually loading the product into the pre-formed bottom portion of the packages.

Wherein said top package sealing station 313, utilizes a tooling similar in its design and functionality to the tooling used by said bottom package forming station. The top package sealing tool may also use a vacuum system for forming the top portion of the package, and a heating element for sealing that top portion of the package to the bottom portion of the package, already pre-filled with the product being packaged.

I claim:

1. A packaging film perforating system, comprising:

a perforating module, comprising a front disc having a front disc bore, a front disc outside perimeter, front disc pin holes, and front disc clearance holes;

a back disc having a back disc bore, a back disc outside perimeter, back disc pin holes, back disc clearance holes, and back disc threaded holes;

knives; each of said knives having a knife sharp edge, a knife blunt edge, and knife clearance holes;

a hub having a hub bore, a hub outside diameter, a hub threaded set screw hole, and hub threaded mounting holes, a shaft;

a mounting module comprising a base plate, base plate knife channels, two actuators, two actuator mounting brackets, guide rods, two bearings, and two bearing blocks;

a plurality of mounting hardware selected from a group consisting of machine screws, bolts, washers, nuts, adhesives, roll pins, and a set screw;

wherein the front disc is fixedly-attached to the back disc, by inserting the machine screws though the front disc clearance holes and into the back disc threaded holes;

the knives are fixedly-located between the back disc and the front disk, by inserting the roll pins through the front disc pin holes, through the knife clearance holes, and into the knife clearance holes; the knives are disposed at equivalent intervals, with each of the knife blunt edge facing in same direction, and configured to protrude outward beyond the front disc outside perimeter, and the back disc outside perimeter;

the hub being mounted to the back disc, by inserting the machine screws, through the back disc clearance holes, into the hub threaded mounting holes, so that the hub outside diameter, is disposed inside the front disc bore;

the shaft being slidably inserted through the hub bore, and releaseably locked to the hub, by inserting the set screw through the hub threaded set screw hole, made to urge upon the shaft, so that a rotation of the shaft will cause a corresponding rotation of the knives;

the mounting module is holding the shaft with the two bearings, with each of the two bearings being held by one of the two bearing blocks, being moved up and down, via the two actuators, guided by the guide rods, with each of the two actuators being mounted to the base plate, via one of the two actuator blocks;

the mounting module is fixedly-attached, via the base plate, to a horizontal form fill and seal packaging machine; the horizontal form fill and seal packaging machine is progressing a packaging film between a plurality of machines stations configured to form packages from the packaging film;

whereby the two actuators are configured to move the knives down, through the base plate knife channels, to perforate the packaging film, so that the blunt edges of the knives are pushed by the packaging film, progressing between the plurality of machines stations, causing the rotation of the shaft, via the two bearings, and the corresponding rotation of the knives, resulting in creation of a perforated line in the packaging film.

* * * * *